United States Patent [19]

Cradeur et al.

[11] 3,959,845

[45] June 1, 1976

[54] APPARATUS AND METHOD FOR CLEANING MINING CARS

[75] Inventors: Robert R. Cradeur, Sulphur, La.; Ronald Webb Holloway, Dunbar, W. Va.

[73] Assignee: Browning-Ferris Industries, Inc.

[22] Filed: Aug. 26, 1974

[21] Appl. No.: 500,289

[52] U.S. Cl. ..... 15/321

[51] Int. Cl.[2] ..... A47L 7/00; A47L 9/00

[58] Field of Search ..... 15/345, 347, 321, 322

[56] References Cited

UNITED STATES PATENTS

| | | | |
|---|---|---|---|
| 705,585 | 7/1902 | Hope | 15/347 |
| 1,042,713 | 10/1912 | Moorhead | 15/322 |
| 1,459,968 | 6/1923 | Bailly | 15/347 X |
| 1,793,469 | 2/1931 | Drake | 15/345 X |
| 2,018,791 | 10/1935 | Kern | 15/345 X |
| 2,064,660 | 12/1936 | Haas | 15/345 X |
| 2,494,773 | 1/1950 | Mead et al. | 15/345 |
| 2,497,435 | 2/1950 | Branneman | 15/321 |
| 2,916,761 | 12/1959 | Oberg | 15/322 |

FOREIGN PATENTS OR APPLICATIONS

| | | | |
|---|---|---|---|
| 455,297 | 1/1928 | Germany | 15/345 |

*Primary Examiner*—Leonard D. Christian
*Assistant Examiner*—Donald B. Massenberg
*Attorney, Agent, or Firm*—Pravel & Wilson

[57] ABSTRACT

A system for cleaning particulate matter from a mining car in which a nozzle directs a high pressure fluid against packed particles within the mining car to loosen the same, and withdraws the packed particles and fluid from the mining car with a vacuum flow thereof.

3 Claims, 4 Drawing Figures

S
F
10
12
14
16
16a
V
20
22
18
P
26
24
28
30
62
36
34
34a
34b
34c
34a
34d
32
40
42
N
38
58
56a
56
56a

Fig. 2
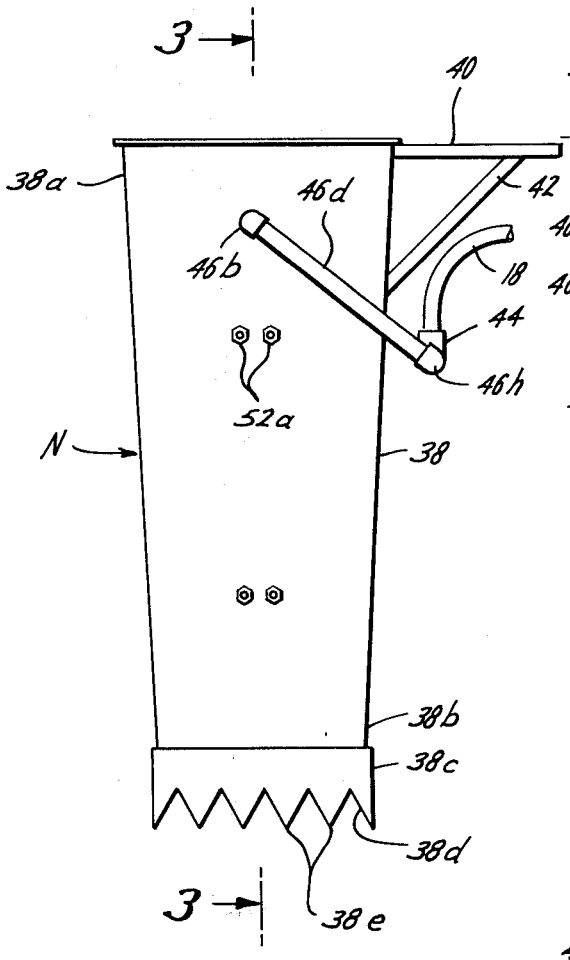
Fig. 3
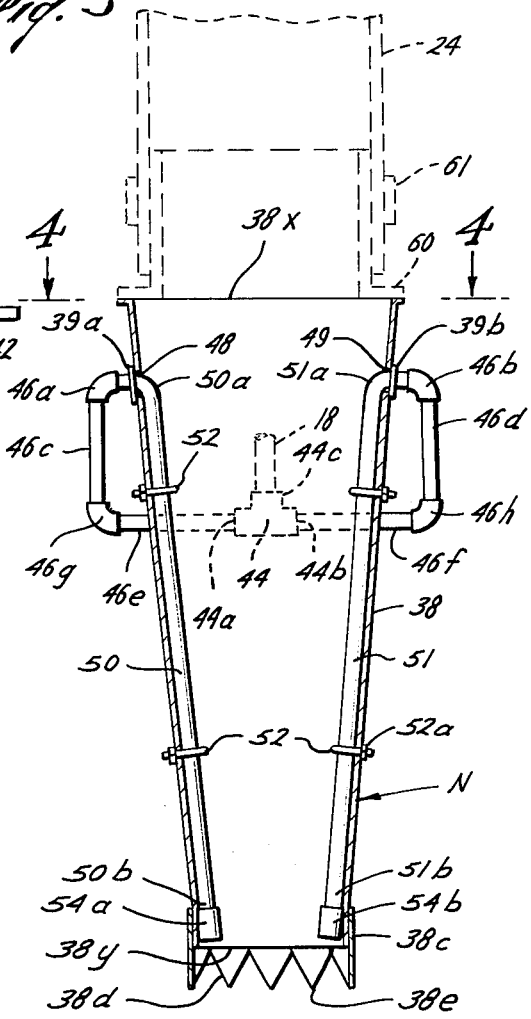
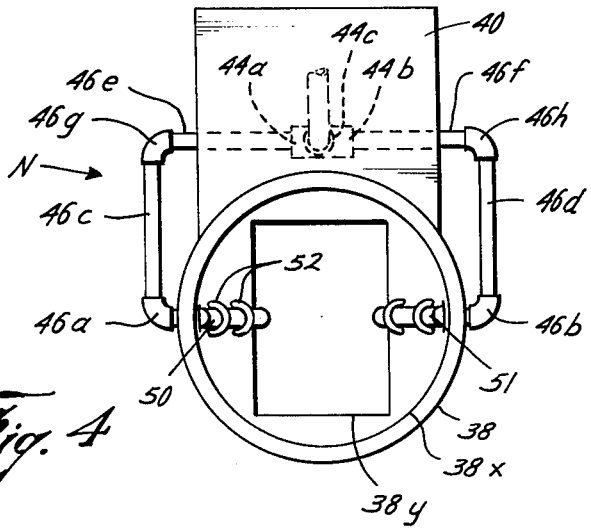
Fig. 4

APPARATUS AND METHOD FOR CLEANING MINING CARS

BACKGROUND OF THE DISCLOSURE

The field of this invention relates to devices and methods used for removing undesired particulate matter.

Over a period of time ore coal or ore mining cars become clogged with packed fines or dust and, it is necessary to remove the packed particles in order to fully utilize the storage space in the cars. Insofar as known, mining cars have been cleaned by four methods. First, manual scoops or shovels were used to loosen packed particulate matter within the mining cars, however this proved to be a time-consuming operation which did not satisfactorily clean the cars. A secondary method of cleaning the cars was to lift the mining cars from their tracks, overturn the cars, and remove the particulate matter by banging on the bottom and sides of the cars with hammers. This method has an inherent disadvantage that each time the car is turned over, the wheel bearings become unseated and consequently require replacement. A third method includes attempting to dislodge the packed material within the mining car with water and flushing it through drainage holes in the bottom of the car. The difficulty with this approach lies in the problem of the holes clogging with particulate matter during this flushing in operation. Lastly, use of a vacuum source for removing the compacted particulate matter has been attempted however, inasmuch as the material is too compacted to be removed by vacuum source alone, this approach has been unworkable.

SUMMARY OF THE INVENTION

Present invention relates to a new and improved apparatus and method for cleaning particulate matter from a mining car. The apparatus has a high volume, positive pressure fluid source having a high pressure fluid line extending from the fluid source adjacent to the mining car, a high volume, negative presure or vacuum source having a vacuum tube extending from the vacuum source adjacent to the mining car, and a nozzle device having the high pressure fluid line and the vacuum tube mounted therewith for providing a vacuum flow that directs the high pressure fluid against packed particles with the mining car to loosen the same, and withdraws the packed particles and fluid therefrom the mining car.

BRIEF DESCRIPTION OF THE DRAWINGS

FIG. 2 is a side, elevational view of the nozzle of the present invention;

FIG. 3 is a front, elevational view of the nozzle of the present invention; and FIG. 4 is a sectional, plan view of the present invention taken along the lines 4—4 of FIG. 3.

DESCRIPTION OF THE PREFERRED EMBODIMENTS

Figure 1:
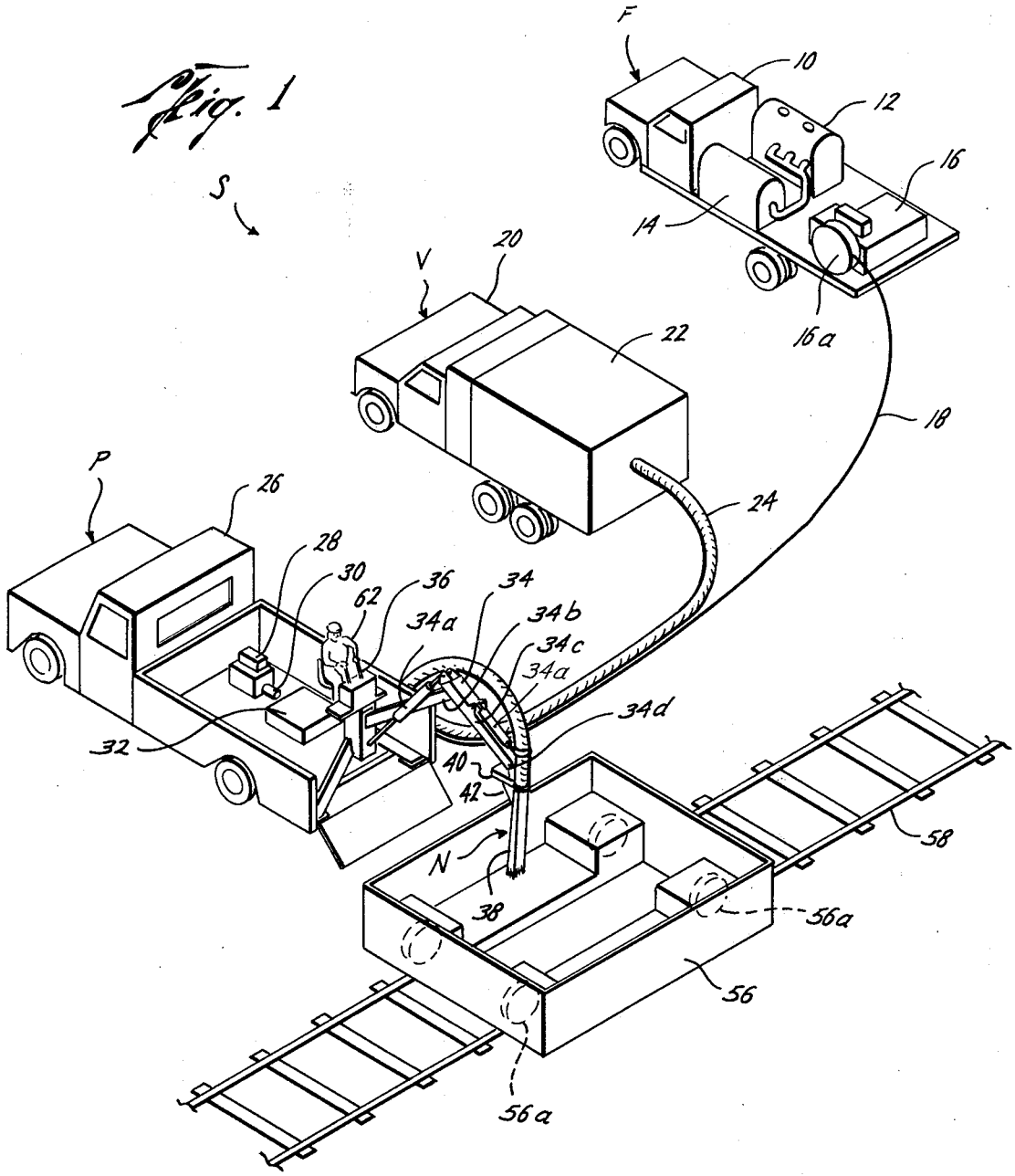
FIG. 1 is an isometric pictorial representation of the preferred embodiment of the system for cleaning mining cars of the present invention.

In the drawings, the letter S designates the system for cleaning particulate matter from mining cars of the present invention, which as shown in FIG. 1 includes a high volume, positive pressure fluid means F and a high volume, negative pressure or vacuum means V connected therewith a nozzle means N.

Considering the invention in more detail, the fluid means F includes a truck 10 having preferably a diesel engine 12 for powering a high pressure pump 14. The high pressure pump 14 preferably is capable of producing pressures between 6000 and 8000 pounds per square inch while maintaining a fluid flow rate of approximately 30 gallons per minute. The high pressure pump 14 is operably connected to the fluid reservoir 16 which is in fluid engagement with a high pressure fluid line 18 preferably of one inch outside diameter. Due to availability and cost considerations, it is preferred that water be used as the fluid medium, but other fluids may be satisfactorily used. The fluid reservoir 16 has a reeling mechanism **16*a* which allows for convenient storage of the high pressure fluid line 18 when the truck 10** moves from location to location.

The vacuum means V preferably includes a truck 20 having a waste disposal compartment 22 mounted therewith which also houses a vacuum pump (not shown) capable of withdrawing air at a rate of preferably 16,000 cu. ft. per min. at pressures of preferably 6 to 8 inches of mercury. A vacuum tube 24 being preferably of 8 inches inside diameter is mounted to the vacuum pump (not shown) and the waste disposal compartment 22, with the vacuum tube 24 extending therefrom.

The nozzle means N is preferably mounted on a positioning means P. The positioning means P includes a truck 26 having an auxiliary engine 28 mounted therewith. The engine 28, preferably a five horsepower diesel, powers a high pressure pump 30 which is connected to an oil reservoir 32. The engine 28, pump 30, and reservoir 32 all provide the fluid pressure (preferably hydraulic) necessary for actuating a "back-hoe" mechanism 34. The back-hoe 34 includes positioning controls 36 which regulate the fluid pressure in pistons **34*a* of the back-hoe 34, thereby controlling the relative position of pivotally connected arms 34*b*, 34*c* of the back-hoe 34.**

As best shown in FIGS. 2 through 4, the nozzle means N includes a nozzzle 38 having a circular cross-sectional area **38*x* adjacent upper end 38*a*, which is adapted to receive the vacuum tube 24, the circular cross sectional nozzle opening 38*x* being gradually contoured into a rectangular cross-sectional nozzle opening 38*y* adjacent lower end 38*b* as will both be more fully described hereinbelow. The nozzle means N is mounted adjacent end 34*d* of the back-hoe 34 with mounting plate 40 mounted adjacent end 38*a* of the nozzle 38. A support plate 42 helps to strengthen the connection of the mounting plate 40 to the back-hoe 34** and provide support thereof.

The nozzle 38 has a base portion **38*c* which has plural serrations 38*d* having lowermost pointed portions 38*e* being disposed thereabout the nozzle opening 38*y* of base portion 38*c*, which will be more fully discussed hereinbelow. Fluid lines 50, 51 are mounted to the interior surface 38*s* of the nozzle 38, being affixed on the interior of the nozzle 38 at ends 50*a*, 51*a*, at respective openings 48, 49 formed in the wall of the nozzle 38 adjacent end 38*a* by retainers 39*a*, 39*b*. The fluid lines 50, 51 extend downwardly from retainers 39*a*, 39*b* and ends 50*a*, 51*a* on the interior surface 38*s* toward end 38*b* of the nozzle 38, having ends 50*b*, 51*b* of fluid lines 50, 51 extending into the area adjacent the base 38*c*. Connectors 52, such as U-bolts having nuts 52*a* therewith or the like, mount the fluid lines 50, 51 firmly to the interior surface 38***s* of the nozzle 38. Nozzle tips 54*a*, 54*b* are mounted with the lower ends 50*b*, 51*b* of the fluid lines 50, 51, respectively, but do not extend below the pointed portions 38*e* of serrations 38*d*.

Retainers 39*a*, 39*b* connected to ends 50*a*, 51*a* of fluid lines 50, 51 at openings 48, 49 are also threadedly connected to connecting pipes 46*c*, 46*d*, respectively. Pipes 46*c*, 46*d* are in turn threadedly connected to pipes 46*e*, 46*f* thru elbows 46*g*, 46*h* respectively. Pipes 46*e*, 46*f* are threadedly joined by T-connector 44 at points 44*a*, 44*b*, respectively. Furthermore, the high pressure fluid line 18 is threadedly mounted to T-connector 44 at inlet 44*c* wherein the fluid flow is divided by connector 44 into two paths through pipes 46*e*, 46*f* along pipe 46*c*, 46*d*, thru fluid lines 50, 51 and outwardly from nozzle tips 54*a*, 54*b*, respectively.

As shown in FIG. 1, a mining car 56 adapted to be used in a mining operation for transporting mined materials thereabout has wheels 56*a* for rollably mounting the mining car 56 on tracks 58 for movement to and from the actual mining operation site to a designated location for cleaning thereof.

In the use or operation of the present invention, when it is desired for a mining car 56 having particulate matter such as coal dust packed therein to be cleaned, the mining car 56 is rolled on tracks 58 to a designated location for cleaning thereof. Once the desired cleaning location is established, trucks 10, 20, and 26 being individually powered, and therefor having mobility are positioned adjacent the mining car 56. The position of nozzle 38 mounted on back-hoe 34 by mounting plate 40 is controlled from the truck 26. Truck 20 of the vacuum means V is positioned adjacent truck 26 with vacuum tube 24 extending therefrom waste compartment 22 and connected to the nozzle 38 at vacuum mount 60 with a suitable clamp 61 securing the vacuum tube 24 thereto. Truck 10 of the fluid means F is thereafter moved adjacent to trucks 20, 26 and high pressure fluid line 18 is unreeled from the reeling mechanism 16*a* and attached to T-connector 44. Diesel engines 12, 28 are started to provide fluid pressure for the fluid means F and hydraulic pressure for powering the positioning means P, respctively. In similar fashion, the vacuum source (not shown), housed in waste disposal compartment 22 is actuated to initiate vacuum flow. An operator 62 controlling both the high pressure fluid flow and the operation of the back-hoe 34, positions the nozzle 38 adjacent to the mining car 56 while the vacuum means V is operative. The operator 62 then activates a valve (not numbered) which releases the high pressure fluid from the fluid reservoir 16 into the high pressure fluid line 18 into the connector 44 through pipes 46*e*, 46*f* then 46*c*, 46*d*, into fluid lines 50, 51 respectively, and out from nozzle tips 54*a*, 54*b*. The high pressure fluid exiting from nozzle tips 54*a*, 54*b* breaks up and erodes away the particulate matter such as coal fines packed within the mining car 56. The plural serrations 38*d* located about the base portion 38*c* of the nozzle 38 allow sufficient opening to draw ample quantities of air so that the vacuum means V may function properly even when the nozzle 38 is positioned such that pointed portions 38*e* contact either the mining car 56 surface or the particulate matter therein. Inasmuch as the vacuum means V is of a high capacity type, the fluid discharged from the nozzle tips 54*a*, 54*b* and the loosened particulate matter are both simultaneously withdrawn up through the nozzle 38 into the vacuum tube 24 and deposited in the waste disposal compartment 22, thus removing both the fluid and the loosened particulate matter.

Furthermore, the system S may be operated in independent fashion; that is, the high pressure fluid is used to loosen the packed particulate matter, resulting in a fluid-matter slurry. Thereafter, the vacuum means V is activated to withdraw the slurry mixture from the mining car 56.

Due to the rectangular configuration of nozzle opening 38*y* of the base 38*c* of the nozzle 38, the operator 62 is able to clean areas adjacent to corner portions in the mining car 56. The operator 62 begins by positioning the base 38*c* of the nozzle 38 at one location within the mining car 56 and works his way about the entire area of the mining car 56 until all the particulate matter is loosened and withdrawn by the vacuum means V. Thereafter truck 20 may dump or discharge the fluid-matter mixture in any suitable manner at any proper location as a dump, or alternatively the mixture could be dried out and thereafter the particulate matter may be used as any mined material.

The advantages of this system include the fact that there is no requirement for personnel to be in the mining car 56 during the cleaning operation. Furthermore, harmful flying dust or particulate matter is minimized due to the vacuum flow of the vacuum means V, hence reducing the risk of injury to the eyes, and/or inhaling harmful dust or particulate matter.

Inasmuch as the fluid means F, the vacuum means V, and the positioning means P are all mounted on trucks 10, 20, and 26 respectively, the entire system S may be easily transported from one location to another to facilitate in cleaning mining cars at a variety of job sites with the same equipment. Furthermore, it will be appreciated that if a more permanent installation is desired, trucks 10, 20, and 26 would not be necessary and the fluid means F, vacuum means V, and positioning means P could be permanently affixed. Thus, the present invention provides a new and improved system S for cleaning mining cars in a fast, efficient manner with the system S being entirely mobile and capable of being moved from job site to job site.

The foregoing disclosure and description of the invention are illustrative and explanatory thereof, and various changes in the size, shape and materials as well as in the details of the illustrated construction may be made without departing from the spirit of the invention.

We claim:

1. An apparatus for cleaning particulate matter from a mining car at a work site, comprising:

fluid means for providing high volume, positive pressure water including separate motor powered fluid means transport vehicle independently mobile and movable from one work site to another and having a fluid pump and fluid reservoir therewith and a high pressure water line extending from said fluid reservoir of said fluid vehicle to the mining car at the work site for loosening packed particles in the mining car;

vacuum means for providing high volume, negative pressure including a separate motor powered vacuum means transport vehicle independently mobile and movable from one work site to another and having a vacuum pump therewith and a vacuum tube extending from said vacuum pump of said vacuum vehicle to the mining car for withdrawing the loosened particles from the mining car at the work site;

nozzle means mounted with said high pressure water line and said vacuum tube for vacuum flow for directing said high pressure water against packed particles within the mining car to loosen said particles and for withdrawing said loosened particles and water from the mining car;

positioning means for positioning said nozzle means within the mining car, said positioning means including a separate motor powered positioning means transport vehicle being independently mobile and movable from one work site to another and having a support mechanism for movably supporting said nozzle means; and, said fluid means and said vacuum means coacting simultaneously at said nozzle means for directing said high pressure water against packed particles within the mining car to loosen the same and simultaneously withdraw the packed particles and water from the mining car, and wherein said support mechanism of said positioning means is a hydraulically operated back-hoe type mechanism.

2. A method for removing packed particulate matter from the base of a mining car at a work site, comprising the steps of: driving a motor powered fluid means transport vehicle, a motor powered vacuum means transport vehicle and a motor powered positioning means transport vehicle onto a work site having mining cars to be cleaned;

connecting a high pressure water line mounted with the fluid reservoir of the motor powered fluid means transport vehicle and a vacuum duct in communication with the vacuum pump of the motor powered vacuum means transport vehicle with a nozzle movably mounted with the motor powered positioning means transport vehicle.

using a hydraulically operated back-hoe type mechanism for positioning the nozzle over packed particulate matter in the mining car to be cleaned;

activating the high pressure fluid pump on the fluid means transport vehicle providing high pressure water and the vacuum means transport pump on the vacuum vehicle providing higb volume, negative pressure;

directing the nozzle with the high pressure water therewith at the packed particulate matter in the base of the mining car to loosen the packed particulate matter;

removing the loosened particles and the water therewith simultaneously by the high volume vacuum pump withdrawing the particles and water therefrom through the vacuum tube into a waste disposal compartment in the means transport vehicle; and repositioning the nozzle in adjacent areas of the base of the mining car until substantially all packed particulate matter is removed therefrom.

3. The system of claim 1, wherein:

said nozzle means is hollow centrally thereof and of a generally cylindrical configuration having an upper portion and a base portion;

said upper portion is of substantially a cylindrical configuration to facilitate mounting of said vacuum tube with said nozzle means;

said base portion of said nozzle means is of substantially a rectangular configuration to enhance accessibility in cleaning corners in the mining car filled with packed particulate matter and said base portion of said nozzle means further having a plurality of serrations disposed about the perimeter of said base portion for providing openings for drawing air for said vacuum means; and said nozzle means having said high pressure water line mounted along the interior surface of said nozzle means with said high pressure water line extending from said upper portion of said nozzle means downwardly to said base portion, with said vacuum tube in communication with said hollow central portion of said nozzle means.

* * * * *